United States Patent [19]

Guay

[11] Patent Number: 4,714,096

[45] Date of Patent: Dec. 22, 1987

[54] ELASTIC FABRIC PROVIDED WITH A LOOPED GRIPPING SURFACE

[75] Inventor: Normand D. Guay, Westerly, R.I.

[73] Assignee: George C. Moore Co., Westerly, R.I.

[21] Appl. No.: 804,271

[22] Filed: Dec. 3, 1985

[51] Int. Cl.[4] ..... D03D 27/04; D03D 15/08; A44B 18/00

[52] U.S. Cl. ..... 139/391; 139/421; 2/DIG. 6; 24/445; 28/161

[58] Field of Search ..... 139/391, 421, 422, 423, 139/402, 403; 2/DIG. 6; 57/225, 243; 28/161; 24/442, 445

[56] References Cited

U.S. PATENT DOCUMENTS

| | | | |
|---|---|---|---|
| 2,246,504 | 6/1941 | Clement | 139/423 X |
| 3,177,904 | 4/1965 | Siverson | 139/391 X |
| 3,534,780 | 10/1970 | Hockmeyer et al. | 139/391 |
| 3,943,981 | 3/1976 | DeBrabander | 139/421 X |
| 4,041,549 | 8/1977 | Atkinson | 2/94 |
| 4,404,999 | 9/1983 | Woodall, Jr. et al. | 139/391 |
| 4,470,250 | 9/1984 | Arenz et al. | 57/225 |

FOREIGN PATENT DOCUMENTS

| | | | |
|---|---|---|---|
| 755230 | 8/1970 | France | 24/445 |
| 330140 | 10/1935 | Italy | 139/391 |
| 645085 | 9/1962 | Italy | 139/391 |
| 375688 | 6/1932 | United Kingdom | 139/421 |

*Primary Examiner*—Stephen Marcus
*Assistant Examiner*—T. Graveline
*Attorney, Agent, or Firm*—Darby & Darby

[57] ABSTRACT

Elastic fabric having a Velcro type hook receiving looped face surface interwoven with monofilament weft yarns, elastomeric warp yarns and texturized warp yarns forming the back face where the weft yarn is heavy enough to maintain weftwise stability of the fabric in its stretched and unstretched condition.

8 Claims, 2 Drawing Figures

ELASTIC FABRIC PROVIDED WITH A LOOPED GRIPPING SURFACE

This invention relates to an elastic fabric which is provided with a looped surface for gripping a mating fabric having a correspondingly hooked surface. More specifically the invention relates to the female member of a velcro type fabric, wherein the loops are provided and maintained throughout the range of elastic elongation by the yarns and weaving pattern utilized in the fabric.

BACKGROUND OF INVENTION

This invention pertains generally to elastic fabrics of the velcro type, i.e. fabrics which are adapted to be held or fastened together by the interlocking of pile hooks (male members) into outwardly extending loops (female member) of the corresponding mating fabric. Velcro is a trademark believed to be owned by Velcro USA Inc. of Manchester, NH, for fabrics of this type. These type fabrics have been known and used for an number of years. While certain elastic Velcro fabrics have been disclosed in the prior art, none is known to be constructed in the manner herein disclosed. Nor is any known to provide the beneficial properties exhibited by the fabrics herein disclosed.

More specifically, DeBrabander U.S. Pat. No. 3,943,981 discloses an elastic Velcro type fabric provided with two specific hooking-up weaves, one supporting hooks and the other supporting loops. Referring to the loops and loop support, the loops are non-stretch "monoyarns" which stand upwardly from a loop support weave comprising multifilament nylon weft and warp with resilient stuffer yarns of natural or synthetic material to provide elasticity in the fabric.

DeBrabander, in order to provide stablity to the fabric, requires a thermal sizing treatment to set or fix the loops on the fabric. This prevents the loops from stretching out during elastic extension which would otherwise render the loops inoperative for receiving the hooks. This thermal sizing step is essential to DeBranbander in order to maintain the fastening characteristics of the fabric. This apparently follows from the fact that DeBrabander uses non-stretch monofilament yarns for the loops. Thus, sizing is essential with DeBrabander to maintain the flatness of the fabric and the upstanding loops in the warp direction.

Morforio U.S. Pat. No. 3,319,307 also discloses a female Velcro fabric. In this arrangement the loops are produced by using a combination of shrinkable warp threads together with partly or non-shrinkable warps. After weaving of the two types of yarns, the fabric is subjected to a heat treatment which shrinks the shrinkable threads and thereby draws the non-shrinkable threads into upwardly extended loops. Thus Morforio, like DeBrabander, requires an intermediate process (heat treatment) in order to achieve this looping action. While Morforio discloses an alternative use of elasticized warps, it appears that this is to provide looping just prior to a setting and fixing stage, since the loops are made of inelastic yarns and thus would flatten out (thereby becoming inoperative) if the fabric were stretched in a warp-wise direction.

Neither of these fabrics, nor any other known fabrics, provide the benefits of the herein disclosed invention as now will be briefly summarized.

SUMMARY OF INVENTION

The present invention provides an elastic fabric having a face surface provided with multifilament texturized yarn loops for fastening by the hooks of a corresponding Velcro fabric. The loops are supported from a wrapped elastomer warp, the back surface of which is woven with a stretch yarn for covering the elastomer, thereby presenting a soft comfortable surface for wearing against the user's skin.

In addition a relatively high denier monofilament weft yarn is used in the support on which the face, elastomer, and back are woven. This weft yarn is sufficiently rigid to hold the face and back yarn and the elastomer in their proper relative position and at the same time maintain the stablity of the fabric, i.e. keep it relatively (weft-wise) flat both when in use and not in use.

Further, with the fabric herein disclosed there is no need for a thermal fixing or sizing step in order to maintain the loops in their hook receiving position throughout the range of elastic stretch of the fabric. Elimination of this intermediate step reduces costs and also provides a superior product in that the disclosed fabric is smoother and softer to the touch than the prior art treated fabrics. Furthermore fixing and sizing steps may create other possible problems, for example the introduction of chemicals which might otherwise result in some irritation to the user's skin, which are avoided in the disclosed fabric.

Thus, among the objects of this invention is to provide a looped Velcro type elastic fabric that maintains the loops in an upright position throughout the elastic elongation of the fabric.

Another object is to provide such a fabric wherein stability is built into the fabric by the particular yarns and pattern employed rather than by a fixing, sizing and/or thermal processing step.

A further object is to provide an elastic Velcro female fabric for use in garments worn directly against the skin with a back (skin-contacting) surface that is soft, supple, and non-irritating to the wearer's skin.

These and other objects, advantages, and novel features of the present invention will become apparent from the following detailed description considered in conjunction with the accompanying drawings.

DESCRIPTION OF THE PREFERRED EMBODIMENTS

Figure 1:
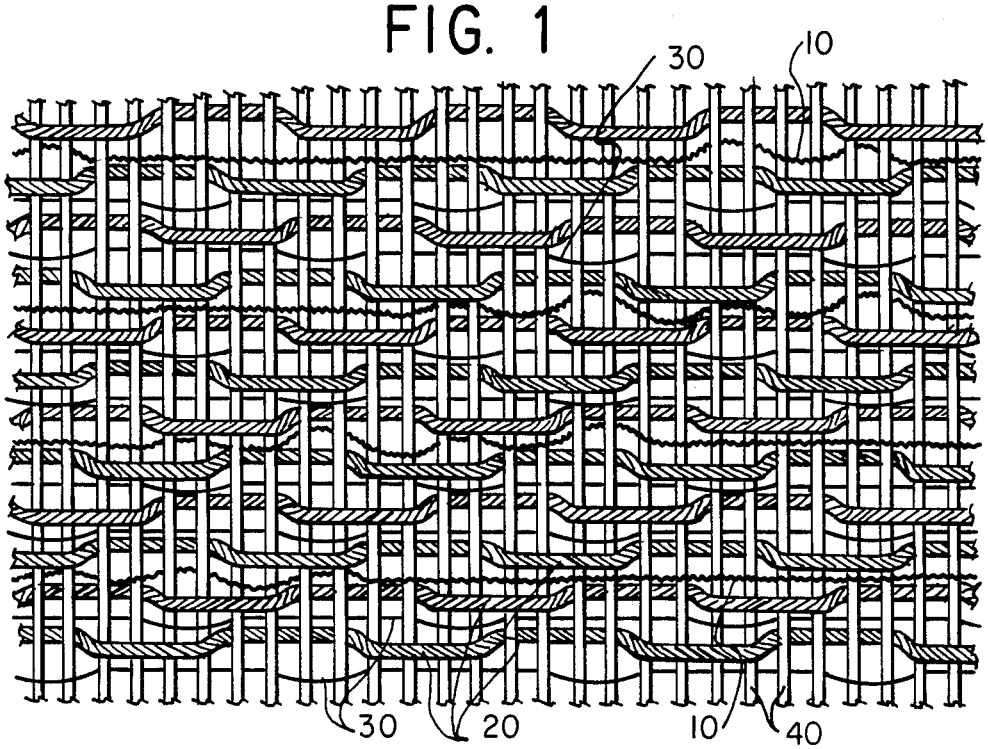
FIG. 1 is a plan view showing a fabric weave incorporating the principles of the present invention.
Figure 2:
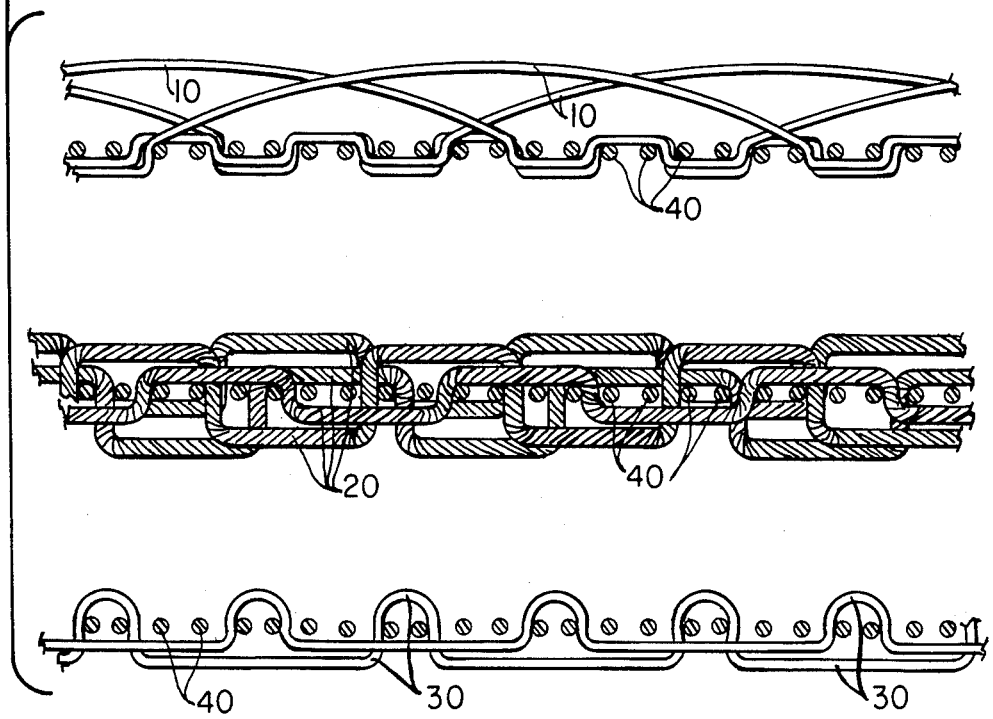
FIG. 2 is a schematic separated elevation of the fabric weave illustrated in FIG. 1, showing the repeat patterns of the yarns used in the fabric weave.

Referring to FIG. 1, there is illustrated an enlarged plan view of a portion of a fabric weave run in accordance with the present invention. FIG. 2 illustrates a separated elevation of the fabric weave shown in FIG. 1, the face or looped surface of the fabric being shown at the top, the elastomer pattern at the center, and the back surface pattern at the bottom. The figures should be considered together in the following description.

The base of the fabric from which the loops 10 extend comprises covered elastomer warp yarns, stretch nylon warp yarns 30 and monofilament weft yarns 40 which are interwoven as illustrated in FIGS. 1 and 2 of the drawing. Elastomer yarns 20 may be 280 denier Lycra covered with 70 denier stretch nylon. Lycra is a trademark for elastic fibers made by E. I. dupont de Nemours & Company, Inc. of Wilmington, Del. The size of the elastomer yarn can vary depending on the desired modulus of elasticity.

Nylon warp yarns 30 may be a 70 denier, 2 ply stretch nylon. This type yarn is used to enhance elasticity of the fabric and also provide a soft surface for bearing against the skin of a wearer. The size of the yarn may be varied depending on the thickness and elongation required. In any event it should be sufficient to cover the elastomer in the fully stetched condition of the fabric.

Weft yarns 40 may be a 180 denier monofilament nylon. The relatively high rigidity of this yarn eliminates the need for any kind of thermal setting and/or backing finish, such as latex, plastic, rubber or the like. This therefore eliminates this intermediate processing step and otherwise possibly irritating surface from the back of the fabric. The size of the weft yarn will vary depending on the stretch and the stability required.

Referring to the drawings elastomers 20 are held by alternately passing over and then under adjacent sets of two picks (each pick 50 consisting of two wefts 40), each adjacent elastomer being offset by a single pick position, so that the pattern repeats on every fourth elastomer.

Nylon warp yarns 30 pass over three picks (six wefts) and then under one pick (two wefts). The wefts are relatively rigid heavy denier yarns to provide weft-wise stability to the fabric.

Referring next to pile loops 20 woven into the base fabric, each pile yarn 10 passes over nine picks and is then held to the base fabric by seven picks. This increased number of tie downs provides more resistance to pulling of the pile yarn. Each pile yarn is tied down to the base fabric in the same manner, but each adjacent yarn passes over its respective nine picks in a staggered warp position, i.e., four picks before commencing its adjacent pass over the nine picks, and the adjacent pile being tied down to the base fabric after the fifth pick. Thus it can be seen that each adjacent pick is alternatively engaging, then releasing and then holding loops yarn 10 in the pattern illustrated in FIG. 2.

In one satisfactory embodiment of a ⅝" wide fabric the loops 10 on the face of the fabric are woven from 60 ends of 200 denier 10 ply multifilament texturized nylon yarn. Warp yarns 30 for the back of the fabric are woven from 64 ends of 70 denier/2 ply stretch nylon. Weft 40 is a 180 monofilament clear nylon yarn. Elastomer yarns 20 are covered elastomer, 96 ends, 280 denier Lycra, covered with 70 denier multifilament stretch nylon to provide a stretch capability of 170%.

The tensions with which the yarns are woven are medium tension for the texturized pile yarn 10, tight tension for the back nylon yarn 30, and medium tight for the monofilament weft yarn 40.

The yarn characteristics, weave pattern, and tensions must be coordinated to provide a weft-wise stable and warp-wise elastic fabric wherein the pile loops on the face of the fabric remain upwardly extended to receive the corresponding Velcro hooks throughout the stretch range of the fabric. Furthermore the back of the fabric must be woven in a pattern and of a yarn such that the elastomer is covered through the full elongation of the fabric.

The above embodiments should therefore be considered only as illustrative of this type of fabric. Other variations and combinations of materials and of weave patterns are available and will be apparent to those skilled in the art in view of this disclosure. It should therefore be understood that there are other variations and combinations which may be made without departing from the scope and spirit of the invention.

What is claimed is:

1. An elastic fabric comprising:

a plurality of texturized multifilament warp loop yarns for forming upwardly extending loops on the face surface of said fabric, monofilament weft yarn interwoven with said loop yarns, a plurality of elastomeric warp yarns interwoven with said loop yarns and with said weft yarn for providing elastic stretch of said fabric, and a plurality of texturized warp back yarns interwoven with said loop and elastomeric warp yarns and with said weft yarn for forming the back surface of said fabric wherein said weft yarn is of a sufficiently heavy denier to maintain weftwise stability of said fabric in its stretched and unstretched condition.

2. An elastic fabric as claimed in claim 1 wherein said loop yarns are woven in a repeat pattern of multiple over and under tie-downs to adjacent wefts followed by a float over a substantially equal number of adjacent wefts, the ratio of the float to each tie-down being in excess of 5:1 so as to maintain upwardly standing loops for connection with corresponding mating pile hooks throughout the range of elastic elongation of said fabric.

3. An elastic fabric as claimed in claim 1 wherein, said elastomeric yarns are covered with a stretch yarn to obtain the predetermined desired stretch characteristics of the fabric.

4. An elastic fabric as claimed in claim 1 wherein said back yarns are of sufficient elasticity and denier to give with the stretch of the fabric through its intended range of stretch and yet maintain an adequate cover of the elastomeric warps on the back surface of the fabric.

5. An elastic fabric as claimed in claim 1 wherein said weft yarn is monofilament nylon yarn of about 180 denier.

6. An elastic fabric as claimed in claim 2 wherein said loop yarns are texturized multifilament nylon of about 200 denier/10 filament material.

7. An elastic fabric as claimed in claim 2 wherein said elastomeric yarns are lycra of about 280 denier covered with nylon stretch yarn of about 70 denier material.

8. An elastic fabric as claimed in claim 2 wherein said back yarns are stretch nylon of about 70 denier/2 ply material.

* * * * *